US007074053B2

(12) United States Patent
Kawakita et al.

(10) Patent No.: US 7,074,053 B2
(45) Date of Patent: Jul. 11, 2006

(54) ELECTRICAL CONNECTION BOX

(75) Inventors: Shinji Kawakita, Mie (JP); Shigeki Yamane, Mie (JP)

(73) Assignees: Autonetworks Technologies Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 11/193,419

(22) Filed: Aug. 1, 2005

(65) Prior Publication Data

US 2006/0030173 A1 Feb. 9, 2006

(30) Foreign Application Priority Data

Aug. 3, 2004 (JP) ..... P2004-227146

(51) Int. Cl.
*H01R 12/00* (2006.01)

(52) U.S. Cl. ..... 439/76.1; 174/76; 174/59; 174/438; 174/621; 174/949

(58) Field of Classification Search ..... 439/76.1, 439/76.2, 621, 949; 174/50
See application file for complete search history.

(56) References Cited

U.S. PATENT DOCUMENTS 4,729,740 A * 3/1988 Crowe et al. ..... 439/76.1
5,928,004 A * 7/1999 Sumida et al. ..... 439/76.2
6,116,916 A * 9/2000 Kasai ..... 439/76.2
6,290,509 B1 * 9/2001 Hattori et al. ..... 439/76.2
6,511,331 B1 * 1/2003 Saito et al. ..... 439/76.2
6,590,777 B1 * 7/2003 Morino et al. ..... 361/736
6,677,521 B1 * 1/2004 Sumida et al. ..... 174/50
6,891,463 B1 * 5/2005 Nagaoka ..... 337/187

FOREIGN PATENT DOCUMENTS

JP 2000-021477 A 1/2000

* cited by examiner

*Primary Examiner*—Tulsidas C. Patel
*Assistant Examiner*—Harshad Patel
(74) *Attorney, Agent, or Firm*—Oliff & Berridge, PLC

(57) ABSTRACT

An electrical connection box includes a case, a connector, a terminal fitting, a cover, and a restricting member. The case has an opening and houses a circuit forming board including a conductive path. The connector is mounted on the circuit forming board to face an outside from an opening end side of the case. The connector has a fitting surface which faces a board surface of the circuit forming board. The terminal fitting is attached to the connector. The terminal fitting is connected to the conductive path of the circuit forming board by soldering. The cover is attached to the opening of the case. The restricting member is provided with the cover and the connector. The restricting member can restrict a displacement of the connector in a direction where the connector is engaged with an opposing connector.

3 Claims, 14 Drawing Sheets

ELECTRICAL CONNECTION BOX

BACKGROUND OF THE INVENTION

1. Field of the Invention

The present invention relates to an electrical connection box.

2. Description of the Related Art

Conventional electrical connection boxes, such as those cars are equipped with, are known to have a structure where a printed circuit board on which connectors for the board have been mounted is included within a case and the connectors face the outside (see, for example, JP-A-2000-21477). Connectors for the board are mounted along the end portions of a printed circuit board in such a manner that the fitting surfaces thereof are aligned along the board surfaces of the circuit boards, and terminal fittings that have been mounted on these connectors are connected to conductive paths of the circuit board by flow soldering, and in addition, this circuit board is contained within a case having an opening in one surface, and the connectors are aligned so as to face the outside from the opening end side of the case.

Here, the connectors for the board are required to have a high holding force, because opposing connectors, such as those which are attached to the terminals of a wire harness, are fit into or removed from the connectors, and therefore, the connectors for the board are fixed by being attached to the opening end of the case with screws.

SUMMARY OF THE INVENTION

In a conventional structure of a portion to which connectors for the board are fixed, an attachment plate is provided so as to protrude from the bottom of the sides of the connectors, and this attachment plate is screwed to the opening end of the case, and therefore, there is a possibility that the connectors for the board are displaced in such a manner that the upper side thereof swings in the case where a large force is applied at the time of engagement and removal of opposing connectors. Therefore, the terminal fittings that have been mounted are also affected, and there is a risk that a problem may arise where cracking occurs, for example, in the soldered portion.

It is an object of the present invention to enhance a holding force of the connectors that have been mounted on a circuit forming board to a case.

According to one aspect of the invention, there is provided an electrical connection box including: a case having an opening, the case housing a circuit forming board including a conductive path; a connector being mounted on the circuit forming board to face an outside from an opening end side of the case, the connector having a fitting surface which faces a board surface of the circuit forming board; a terminal fitting being attached to the connector, the terminal fitting being connected to the conductive path of the circuit forming board by soldering; a cover being attached to the opening of the case, and a restricting member being provided with the cover and the connector, the restricting member capable of restricting a displacement of the connector in a direction where the connector is engaged with an opposing connector.

When a counterpart connector is engaged with or removed from the connector, a pushing or pulling force in a frontward and rearward direction with respect to the connector works on the connector, whereas a restricting member provided between the cover and the connector can restrict a displacement of the connector relative to the circuit forming board in the frontward and rearward direction with respect to the connector. The connector is prevented from being displaced when a terminal fitting is elastically deformed. Therefore, a soldered portion of the terminal fitting can be prevented from being damaged, for example, cracked. As a result, high reliability can be gained in an electrical connection between the connector and the circuit forming board.

According to another aspect of the invention, a protruding portion and a recess portion are capable of fitting together when the cover is attached to the opening of the case. The protruding portion and the recess portion are provided between a rear surface of the cover and an upper surface of the connector.

When the cover is attached to the case, the protruding portion and the recess portion provided on the rear surface of the cover and on the upper surface of the connector fit together, and the connector is restricted so as to be kept from being displaced in the direction of engagement vis-à-vis the counterpart connector.

According to another aspect of the invention, a sandwiching portion for sandwiching both sides of said connector is provided to the cover.

As the cover is attached, the sandwiching portion provided to the cover sandwiches both sides of the connector. Twisting of the connector becomes difficult when, for example, the opposing connector is engaged or removed, and the terminal fitting can be prevented from being elastically deformed.

BRIEF DESCRIPTION OF THE DRAWINGS

These and other objects and advantages of this invention will become more fully apparent from the following detailed description taken with the accompanying drawings in which.

DESCRIPTION OF THE PREFERRED EMBODIMENTS

Embodiment

In the following, an embodiment of the present invention is described in reference to FIGS. 1 to 14.

Figure 1:
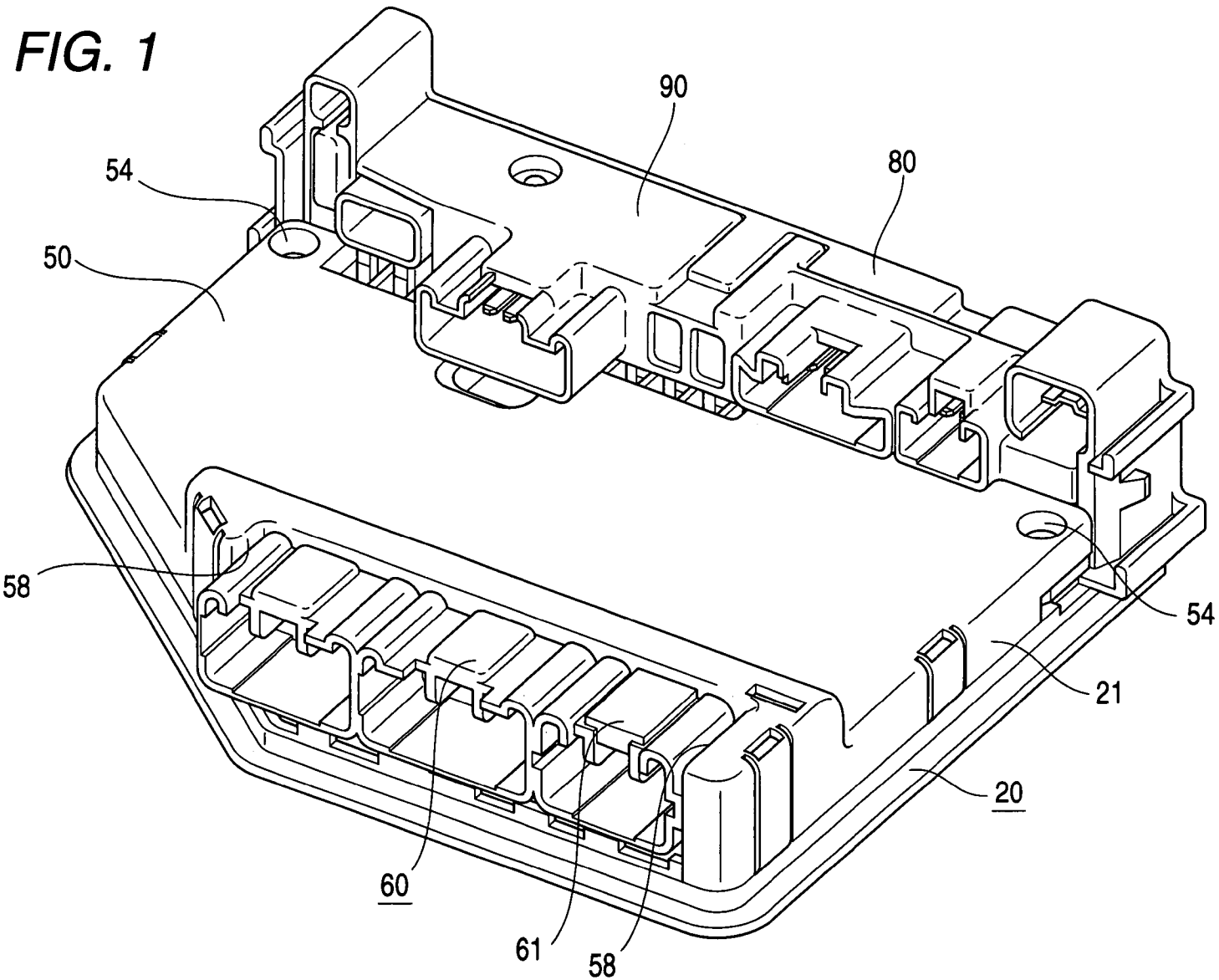
FIG. 1 is a perspective view of the appearance of an electrical connection box according an embodiment of the present invention.
Figure 2:
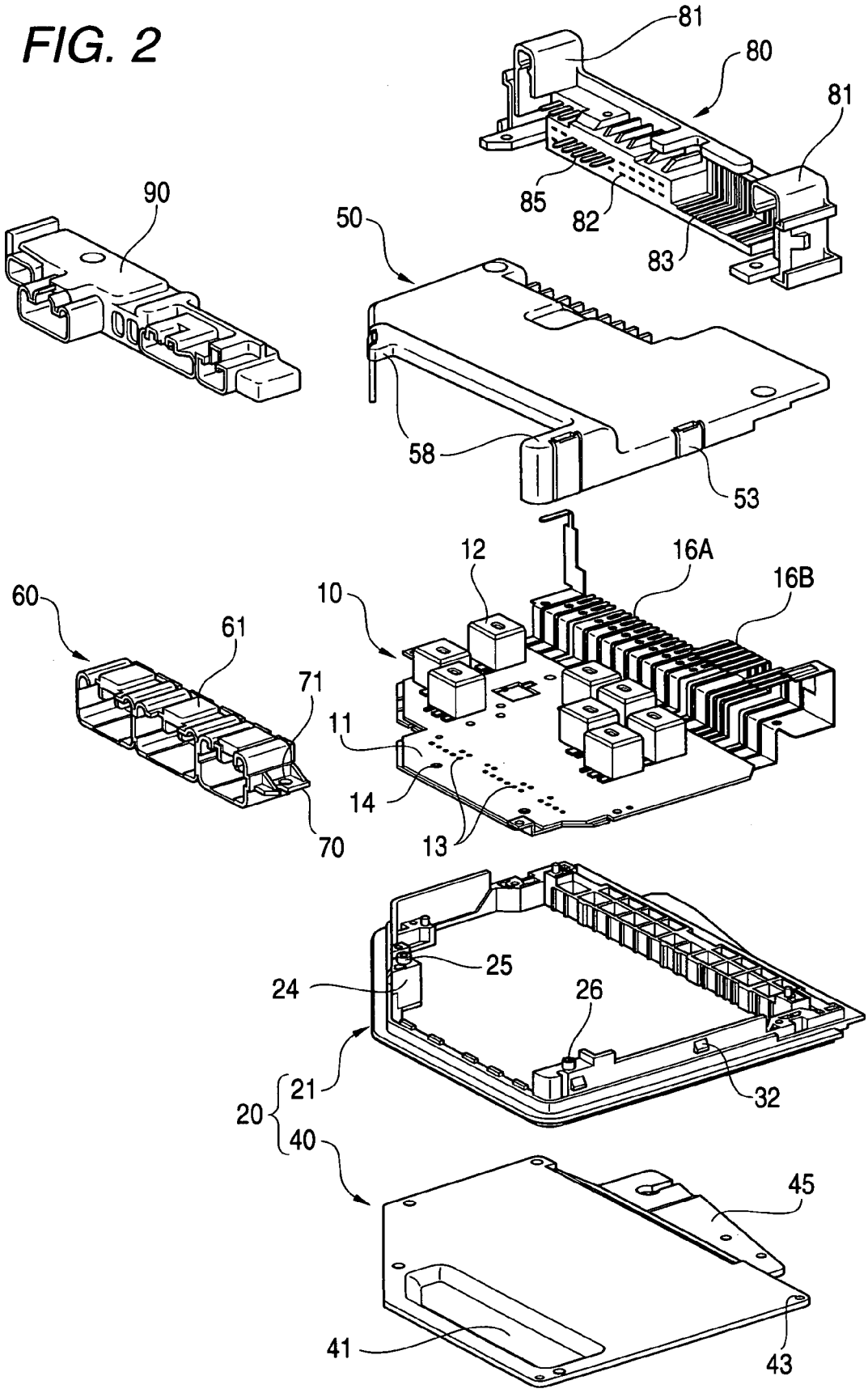
FIG. 2 is an exploded perspective view.

As shown in FIGS. 1 and 2, an electrical connection box according to the embodiment is formed of a circuit forming board 10, a case 20 made of a frame 21 and a heat radiating plate 40 for including this circuit forming board 10, and a cover 50, and furthermore, is formed so that a PCB connector 60 and a fuse box 80 are mounted on the electrical connection box. Here, another relay connector 90 is engaged with fuse box 80.

In the following, the respective members are described, with the front on the front left side and the rear on the right rear side in FIG. 2.

Figure 4:
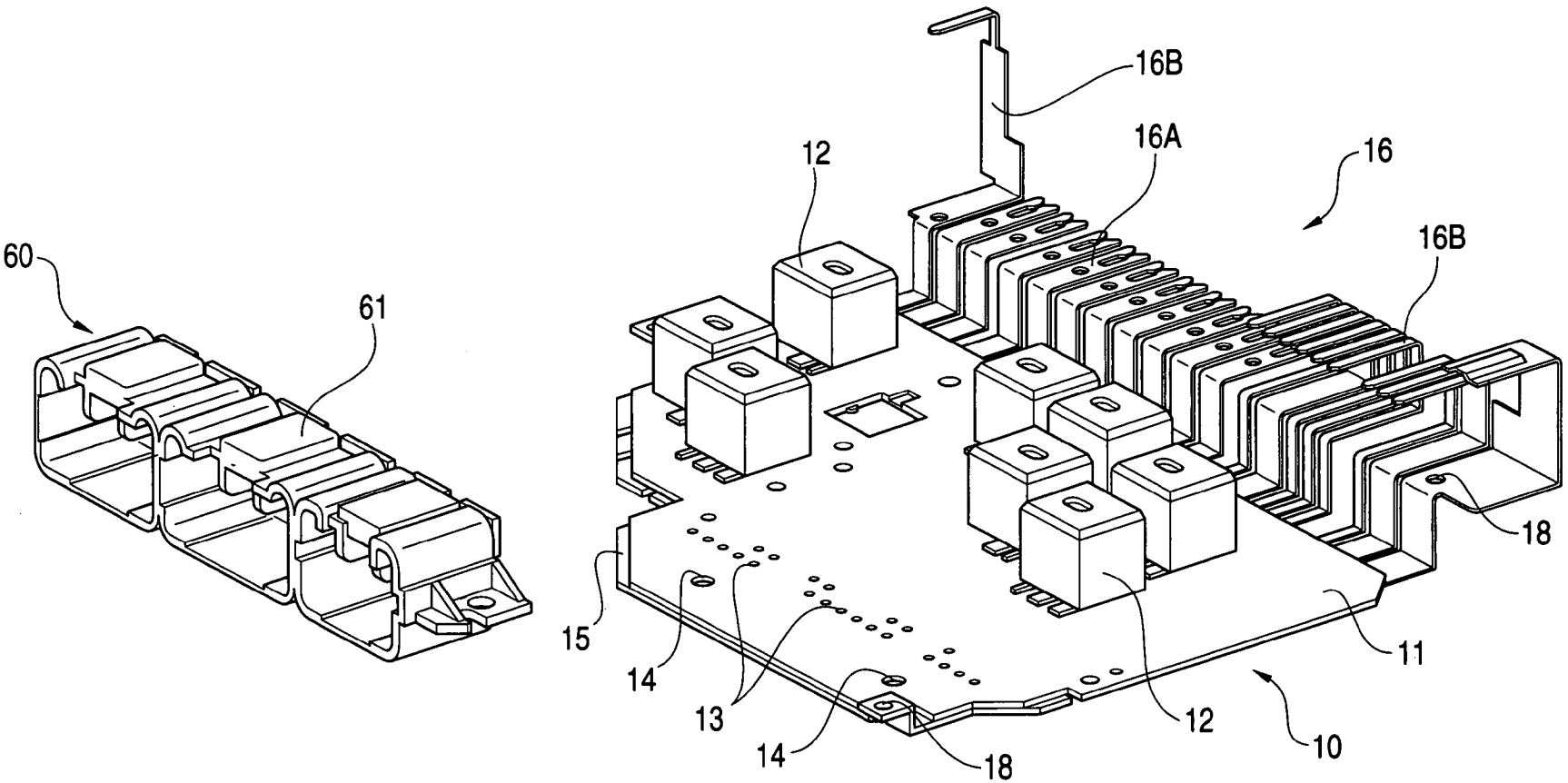
FIG. 4 is a perspective view of the PCB connector in a state where the PCB connector is mounted on the circuit forming board.

As shown in FIG. 4, circuit forming board 10 is formed of a printed circuit board 11 (hereinafter referred to as circuit board 11) and a bus bar 15 that is provided on the rear surface side of circuit board 11, and is formed so that electrical parts 12, such as relays, can be mounted on the front surface side.

The circuit board 11 is formed so as to have an outer shape where a front left side corner is cut off from a rectangle, and conductive paths in a predetermined pattern are formed on both surfaces, the front surface and the rear surface, of the circuit board. In addition, through holes 13 into which male terminals 62 of PCB connector 60 are to be inserted (see FIG. 5) are formed on the front portion side of circuit board 11.

Bus bar board 15 is formed by punching a metal plate having excellent conductivity so as to form a predetermined conductive path that becomes a power circuit, and is formed so as to have an outer shape which approximately matches circuit board 11, and where a number of bus bars 16 are aligned so as to protrude from the rear end. Bus bars 16*a* which are aligned almost throughout the left side region, excluding the leftmost one as viewed from the front, from among the bus bars 16 are bent twice at right angles on the front surface side of circuit board 11, and thereby, the ends of these bus bars protrude laterally toward the rear, and slits into which fuses are inserted are formed at the ends. In addition, the remaining bus bars 16*b* are bent twice at right angles, and thereby, the ends protrude laterally towards the front. Here, window holes 17 (see FIG. 5) are opened in the regions of bus bar board 15 which correspond to the regions of circuit board 11 where through holes 13 are formed.

Circuit board 11 and bus bar board 15 adhere to each other via a thin adhesive sheet (not shown) having insulating properties, so as to be integrated.

Figure 5:
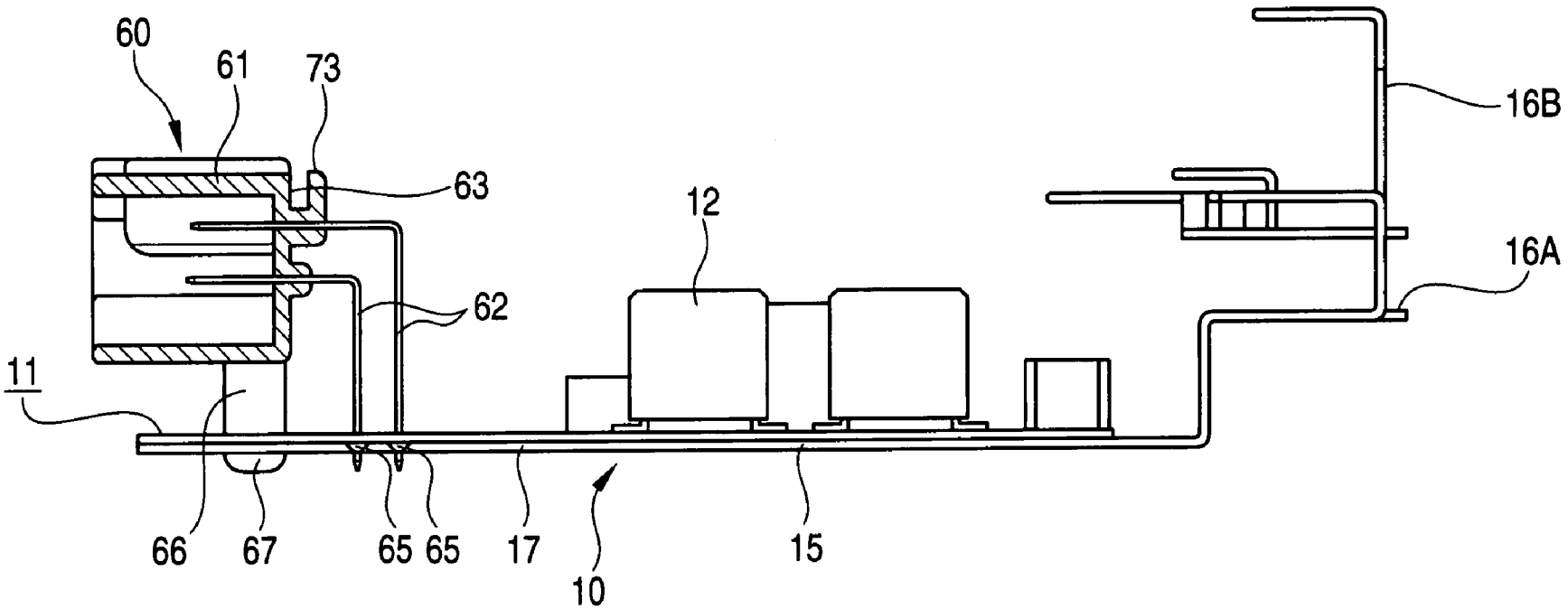
FIG. 5 is a cross sectional side view of a portion of the PCB connector in a state where the PCB connector is mounted on the circuit forming board.

As shown in FIG. 5, PCB connector 60 is provided with a housing 61 which is long in the lateral direction and made of a synthetic resin with an opening in the front, and male terminals 62 that have been formed so as to be bent in an L shape are attached to the housing 61 and aligned in two rows, in a state where one end protrudes within the opening and the other end penetrates through the rear wall 63 and protrudes downward. The end of each male terminal 62 that protrudes downward is inserted from above into a through hole 13 that has been opened in circuit substrate 11 and connected to a land portion that has been formed around the through hole 13 on the rear surface side by soldering (soldered portion 65). In addition, a pair, left and right, of attachment legs 66 are formed on the rear end side and the lower surface of PCB connector 60. These attachment legs 66 are placed on the surface of circuit forming board 10 and fixed with tapping screws 67 which are screwed from the lower surface side through penetrating holes 14.

The entirety of case 20 is formed in a shallow plate form, in order to include circuit forming board 10, and has a structure where heat radiating plate 40 is fit into and placed on the bottom of side frame 21 that corresponds to the surrounding walls.

Figure 6:
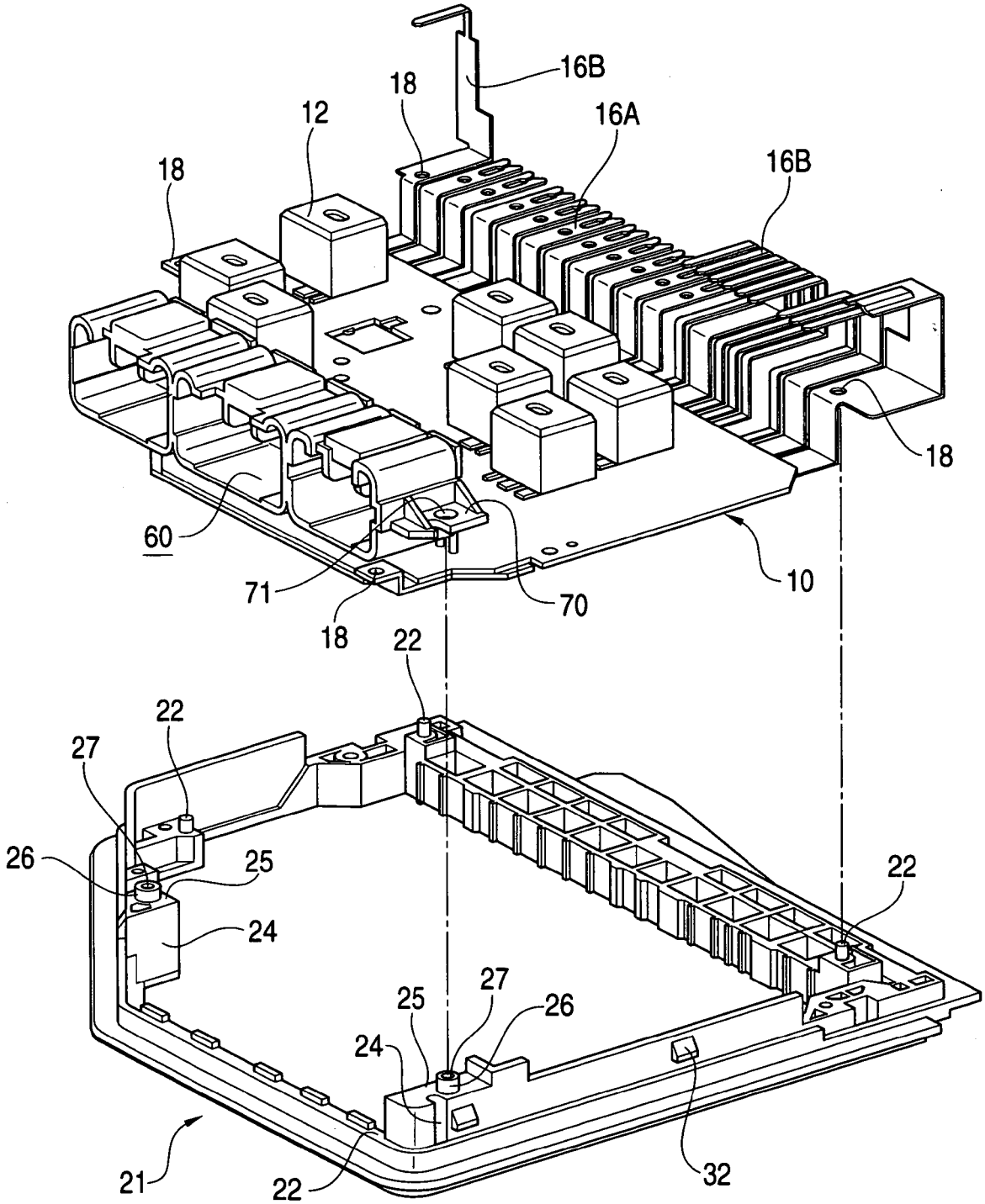
FIG. 6 is a perspective view showing the operation of fitting the circuit forming board into the frame.
Figure 8:
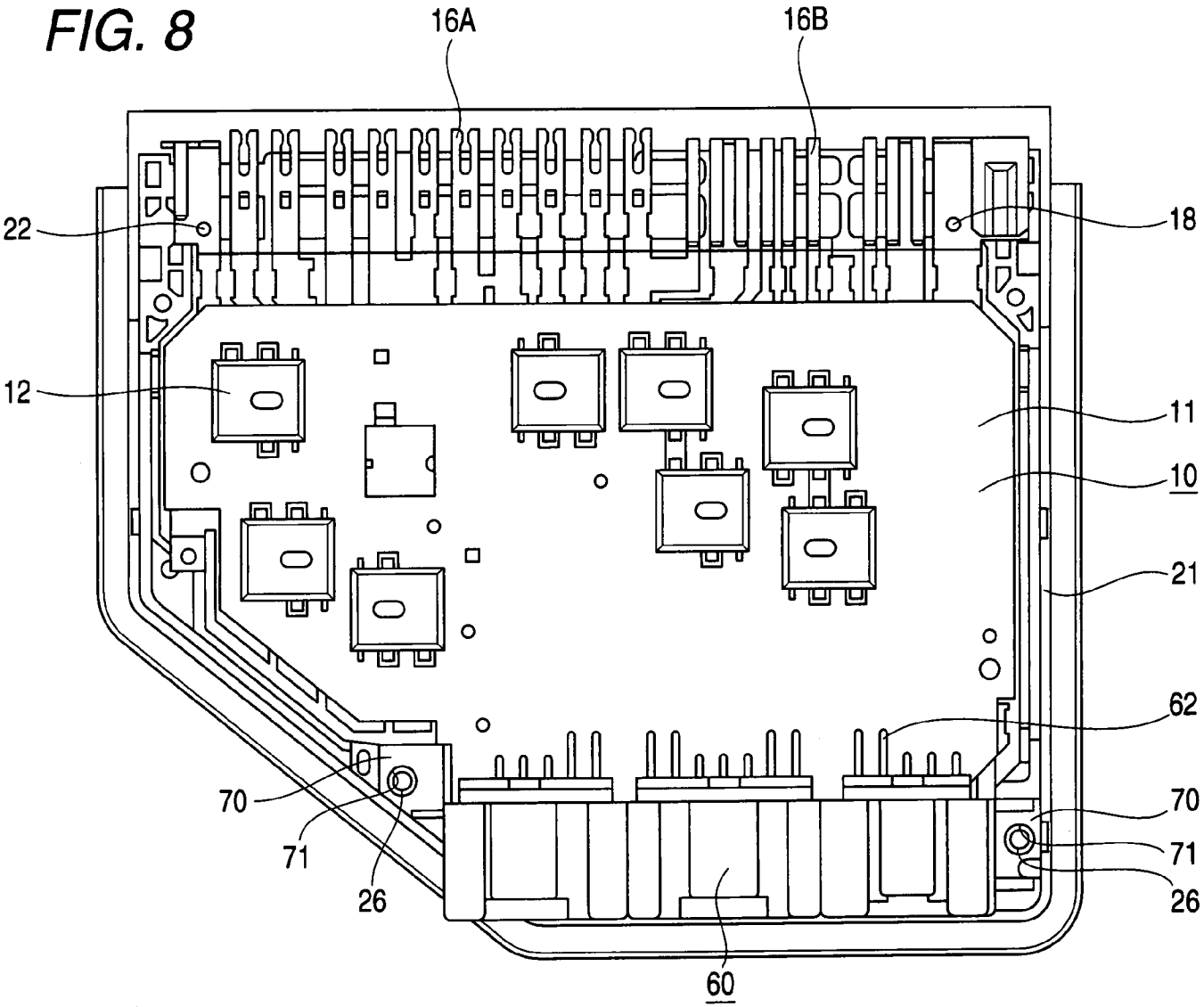
FIG. 8 is a plan view showing the circuit forming board in a state of engagement with the frame.

Frame 21 is made of a synthetic resin, and, as shown in FIGS. 6 and 8, is formed so as to be in a shape where the circuit board 11 and bus bar board 15 can be relatively tightly fit into the inside.

Positioning pins 22 are made to stand on the upper surface of the four corners of frame 21. Positioning holes 18 into which positioning pins 22 are to be fit are opened in corresponding positions of bus bar board 15 and bus bars 16 of the circuit forming board 10.

Figure 9:
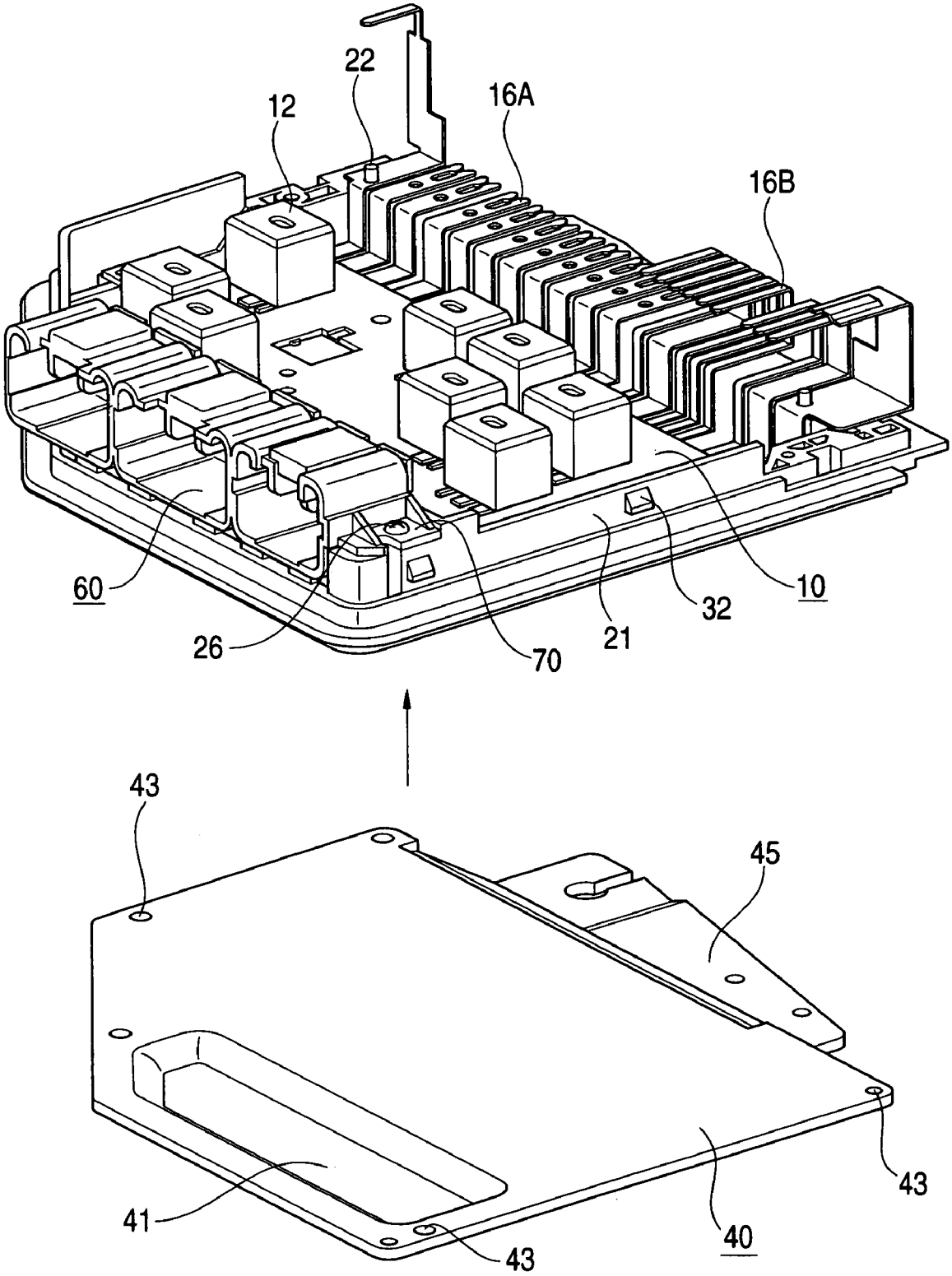
FIG. 9 is a perspective view showing the operation of attaching the heat radiating plate to the lower surface of the frame.

Heat radiating plate 40 is provided in order to radiate heat that is generated in electrical parts 12, and is formed of a metal plate, such as aluminum, having high heat conductance, in a form which is approximately the same as the outer shape of frame 21, as shown in FIG. 9. An escape recess 41 is formed on the front portion side of heat radiating plate 40, in order to avoid interference with the ends of male terminals 62 that have been attached to PCB connector 60 and protrude from the lower surface side of circuit board 11. Penetrating holes 43 for tapping screws 42 (FIG. 11) are formed at appropriate intervals in the periphery of heat radiating plate 40, and the peripheral portion of heat radiating plate 40 is fitted into the lower surface of frame 21 and secured with tapping screws 42 that have been screwed. Meanwhile, bus bar board 5 of circuit forming board 10 is made to adhere to the upper surface of heat radiating plate 40 by an insulating adhesive 44 (see FIG. 10).

Here, an attachment piece 45 is formed on the rear end of heat radiating plate 40 in a diagonally downward and outward protrusion.

Figure 7:
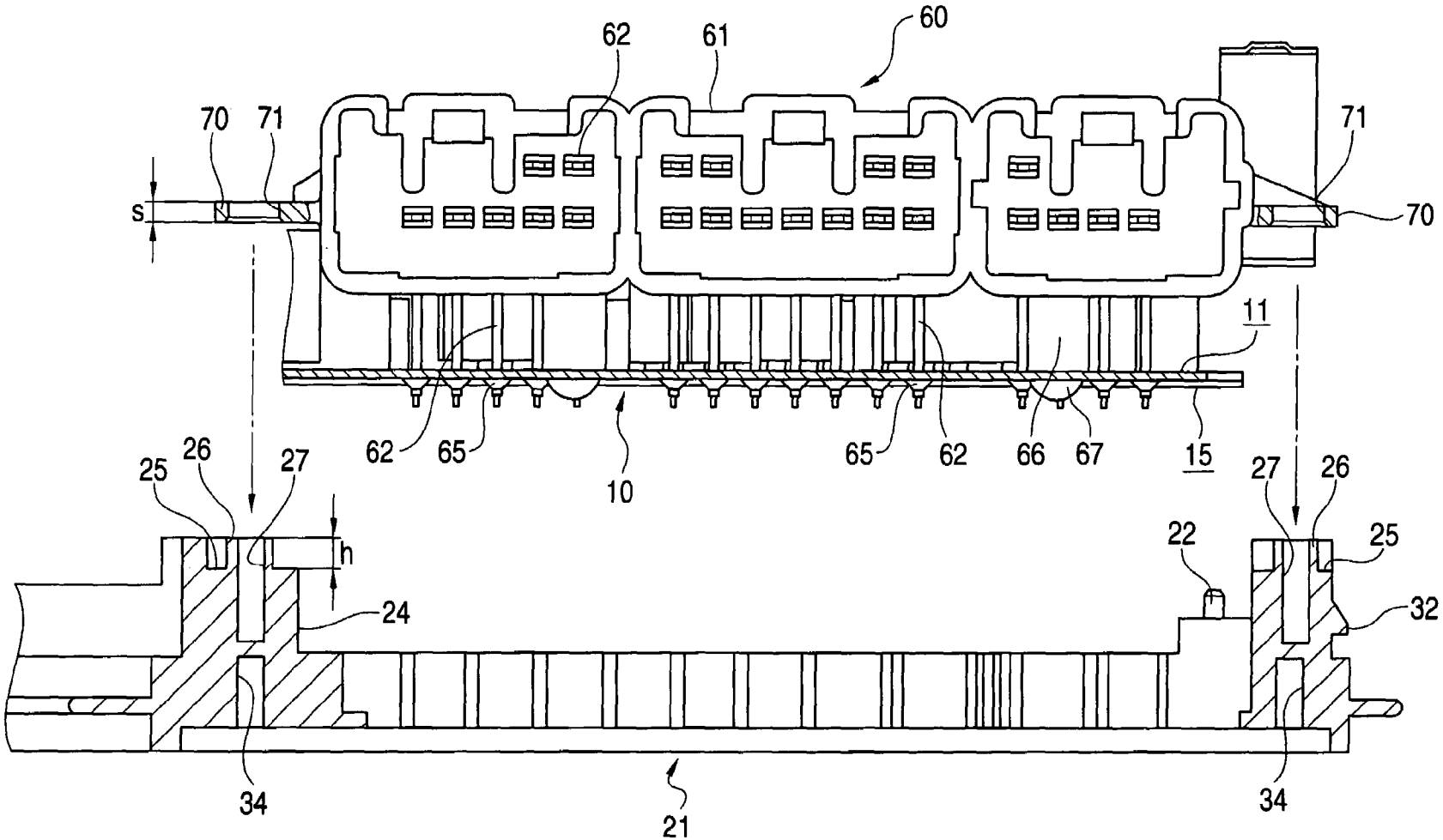
FIG. 7 is a cross sectional front view of a portion of FIG. 6.

Here, PCB connector 60 that has been mounted on the circuit forming board 10 is placed along a region on the front end side of frame 21 of case 20, specifically, a region from the right end of the front end to a portion that is slightly on the diagonal portion where the left corner is cut off, as shown in FIG. 8, and thus, is secured. Therefore, as shown in FIGS. 6 and 7, a pair of attachment supports 24 are formed in the positions inside the front end of frame 21 which correspond to the two ends, left and right, of the mounting region. The attachment surface semiconductor substrate 25, which are upper surfaces of these attachment supports 24, are formed at the same level.

Figure 11:
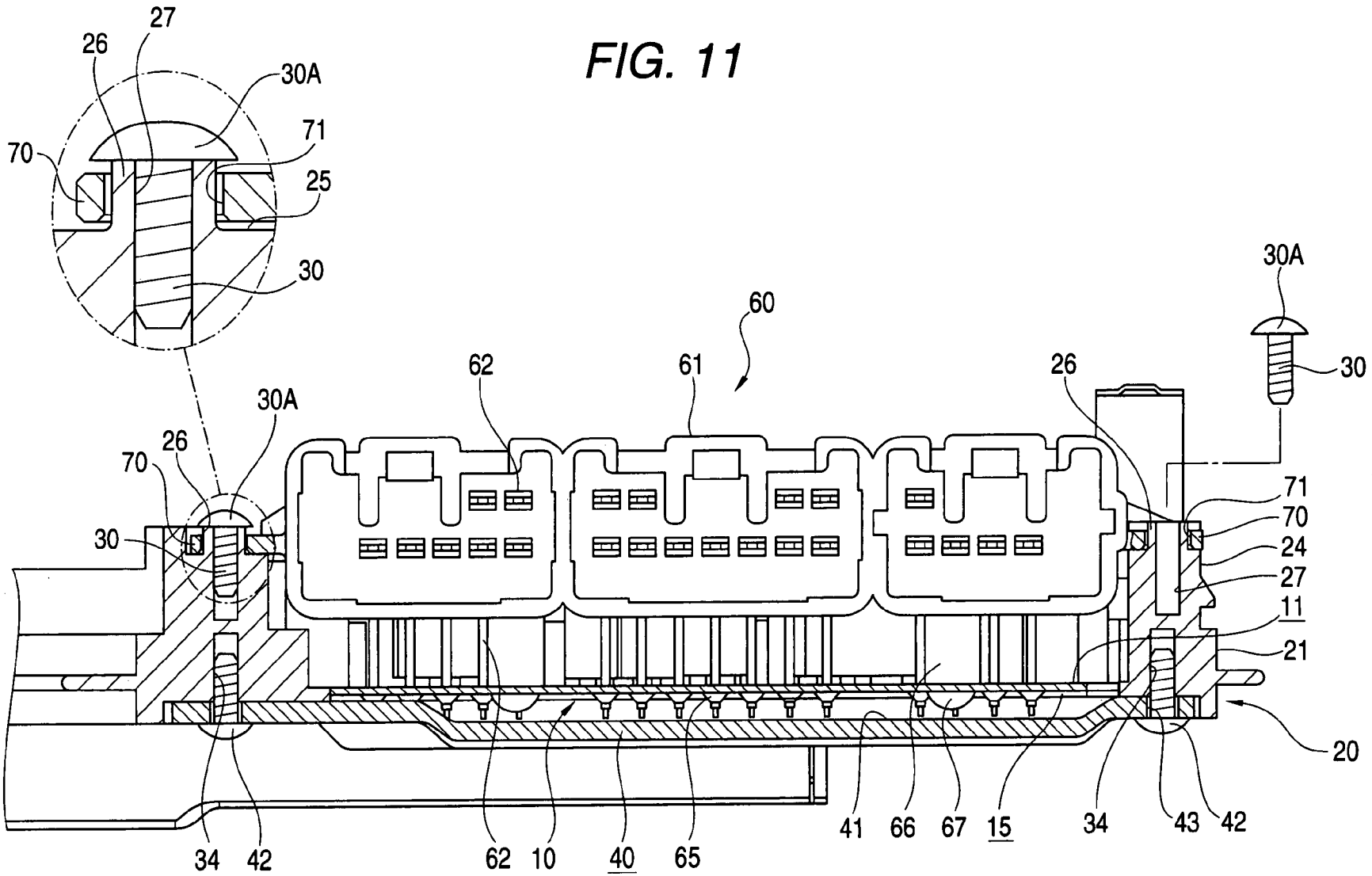
FIG. 11 is a cross sectional front view showing a portion of the PCB connector during the operation of securing the PCB connector to the frame.

Fitting protrusions 26 in short columnar form are formed on the respective attachment surfaces 25. Screw holes 27 (downward holes) are formed in the upper surfaces of fitting protrusions 26, in the downward direction. Tapping screws 30 with heads 30A can be screwed into these screw holes 27, as shown in FIG. 11. The tapping screws 30 can be screwed until the lower surfaces of heads 30A hit the upper surfaces of fitting protrusions 26, and heads 30A have a diameter that is greater than those of fitting protrusions 26.

Meanwhile, as shown in FIG. 7, attachment plates 70 are formed in and protrude from the positions which are approximately the center of the left and right sides of housing 61 of PCB connector 60. Through holes 71 into which the fitting protrusions 26 can be fitted with a slight clearance in the direction of the diameter are formed in the respective attachment plates 70. The corners of through holes 71 on the lower side are rounded for guidance, and heads 30A of the tapping screws 30 stop at the corners of these through holes 71, on the upper side.

Here, it should be noted that the plate thickness s of attachment plates 70 is set to a value that is smaller than that of the height h of the fitting protrusions 26 by a predetermined value. In other words, in the case where fitting protrusions 26 are fitted into through holes 71 so that the lower surfaces of attachment plates 70 hit attachment surfaces 25, a clearance of the predetermined value is secured between the corners of through holes 71 on the upper side and heads 30A of tapping screens 30 that have been screwed to the maximum into fitting protrusions 26, according to this setting.

In addition, a measure for enhancing the holding force of PCB connector 60 in the case where an opposing connector is engaged with and removed from the PCB connector is taken using cover 50.

Figure 13:
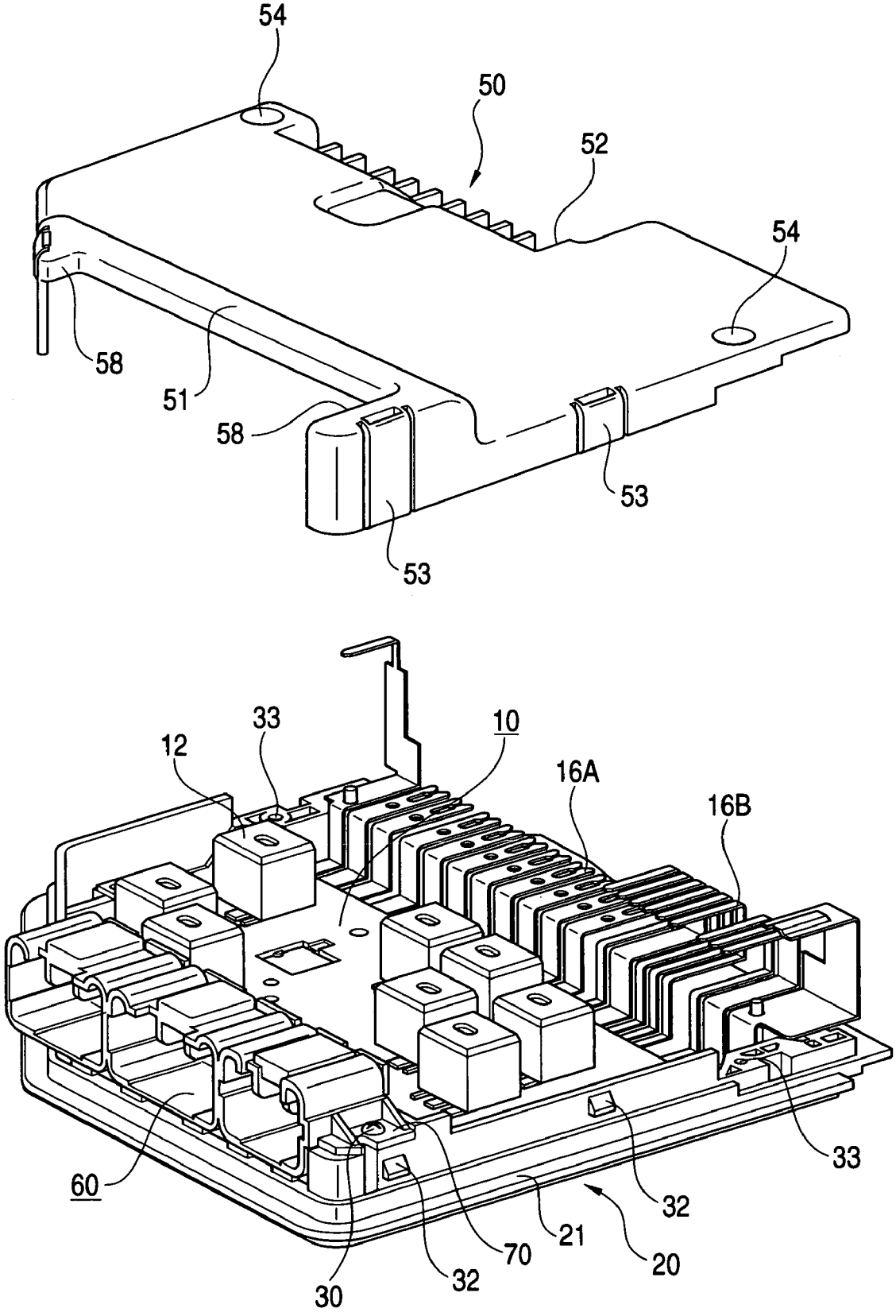
FIG. 13 is a perspective view showing the operation of attaching the cover.
Figure 14:
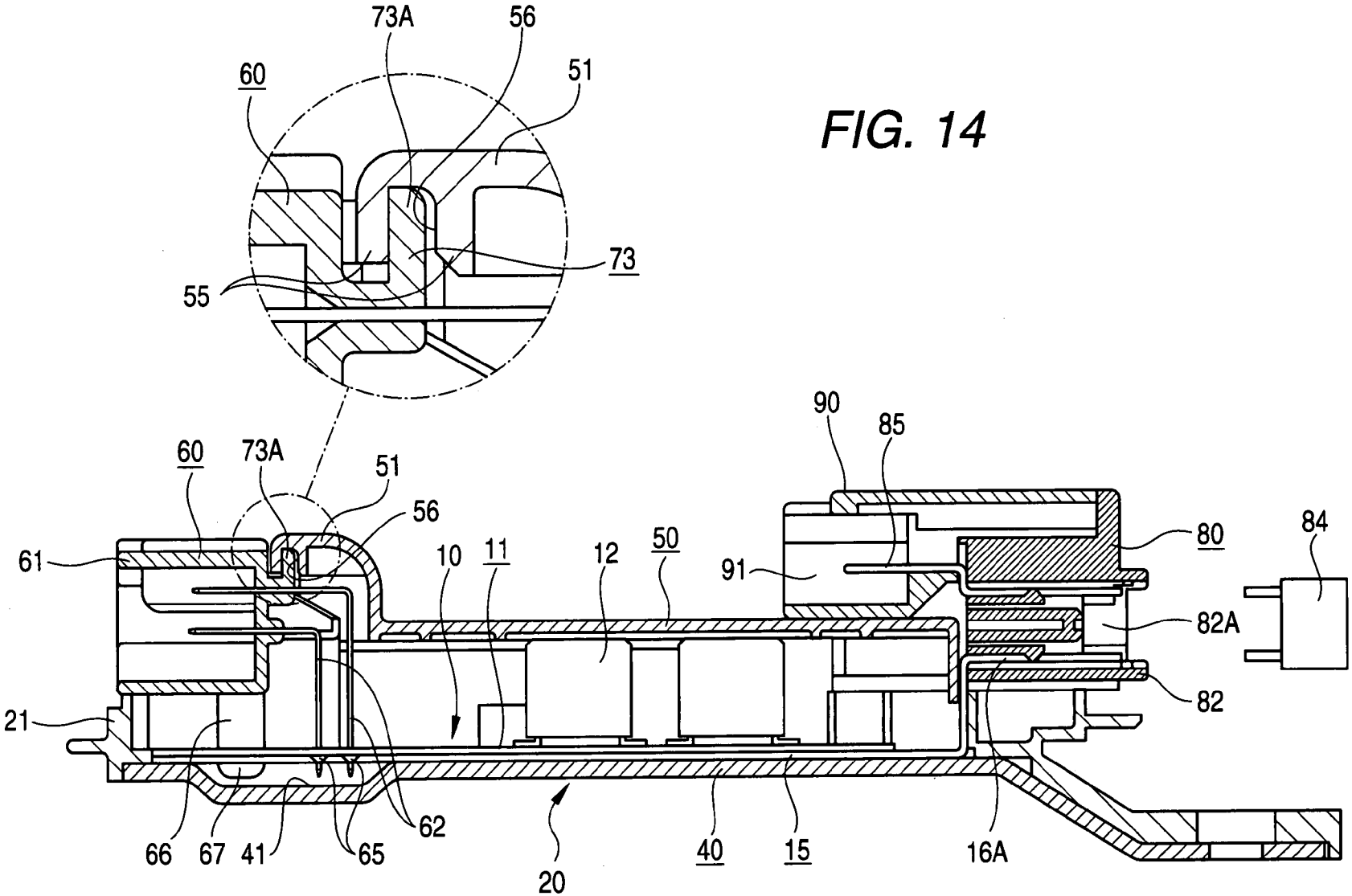
FIG. 14 is a cross sectional side view of the cover in the attached state.

Cover 50 is made of a synthetic resin, and can be attached so as to almost completely cover the opening on the upper surface of case 20, as shown in FIGS. 13 and 14, and a high level portion 51 for covering the rear surface side of PCB connector 60 is formed on the front end side, while an escape recess 52 for partially leading out fuse box 80 that has been fitted in is formed on the rear end surface. Locking pieces 53 which are flexible are provided on the left and right sides of cover 50, while locking protrusions 32 which engage with and temporarily hold locking pieces 53 are provided on the left and right sides of frame 21. In addition, recesses 54 for the attachment of tapping screws (not shown) are provided in the two end portions on the rear end side of cover 50, and the screws can be screwed into screw holes 33 (downward holes) that have been provided in the upper surfaces of the left and right side walls of frame 21.

Figure 3:
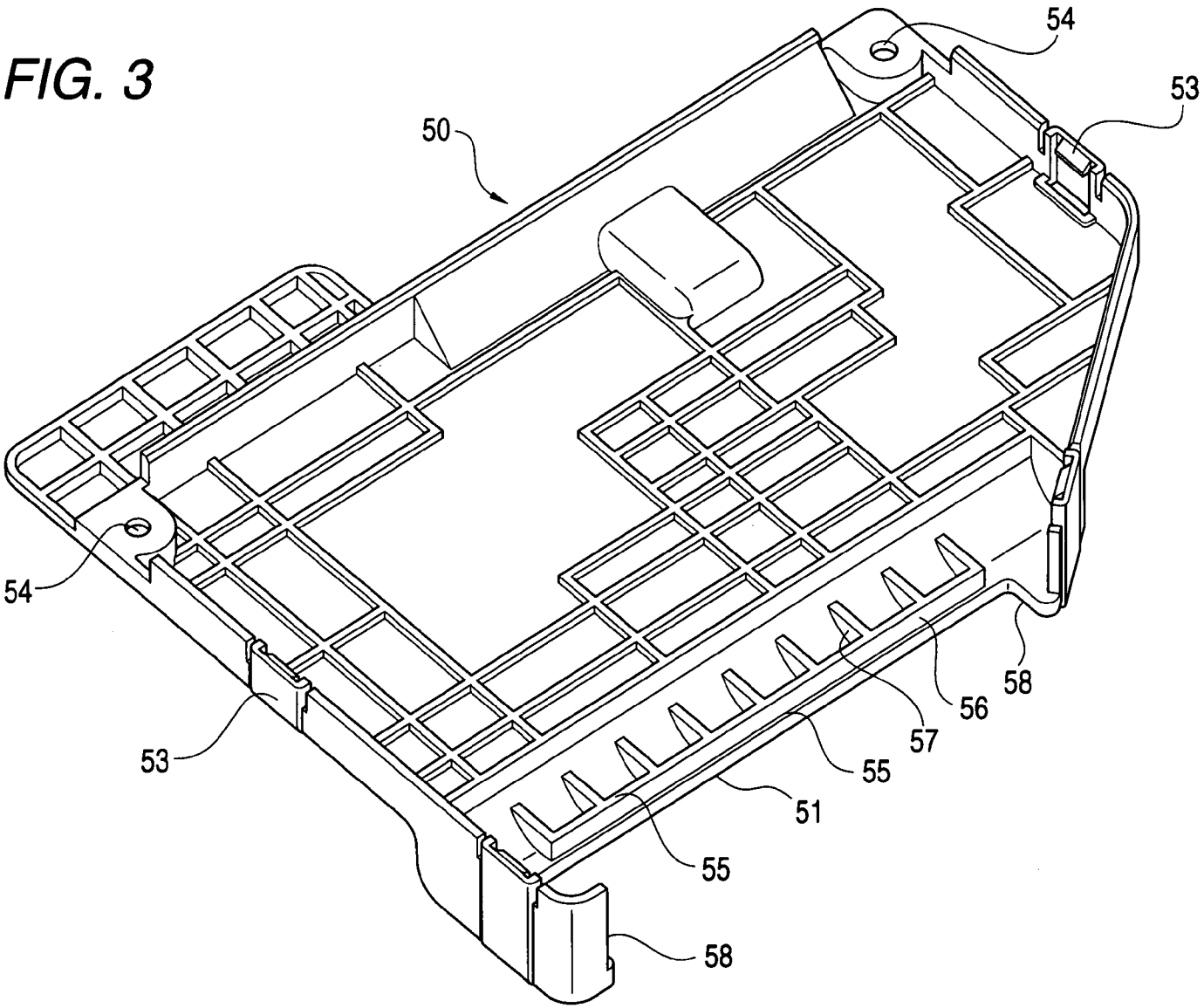
FIG. 3 is a perspective view of the rear of the cover.

Here, as shown in FIGS. 3 and 14, a pair of protruding walls 55 is formed on the rear surface of high level portion 51 of cover 50 so as to be positioned along almost the entire length of the front end and behind the front end, in a state where the pair of protruding walls 55 are parallel to each other with a predetermined gap in between, where an engagement trench 56 having a predetermined depth is formed between the two protruding walls 55. Protruding wall 55 on the rear side is reinforced with a reinforcing rib 57.

Figure 12:
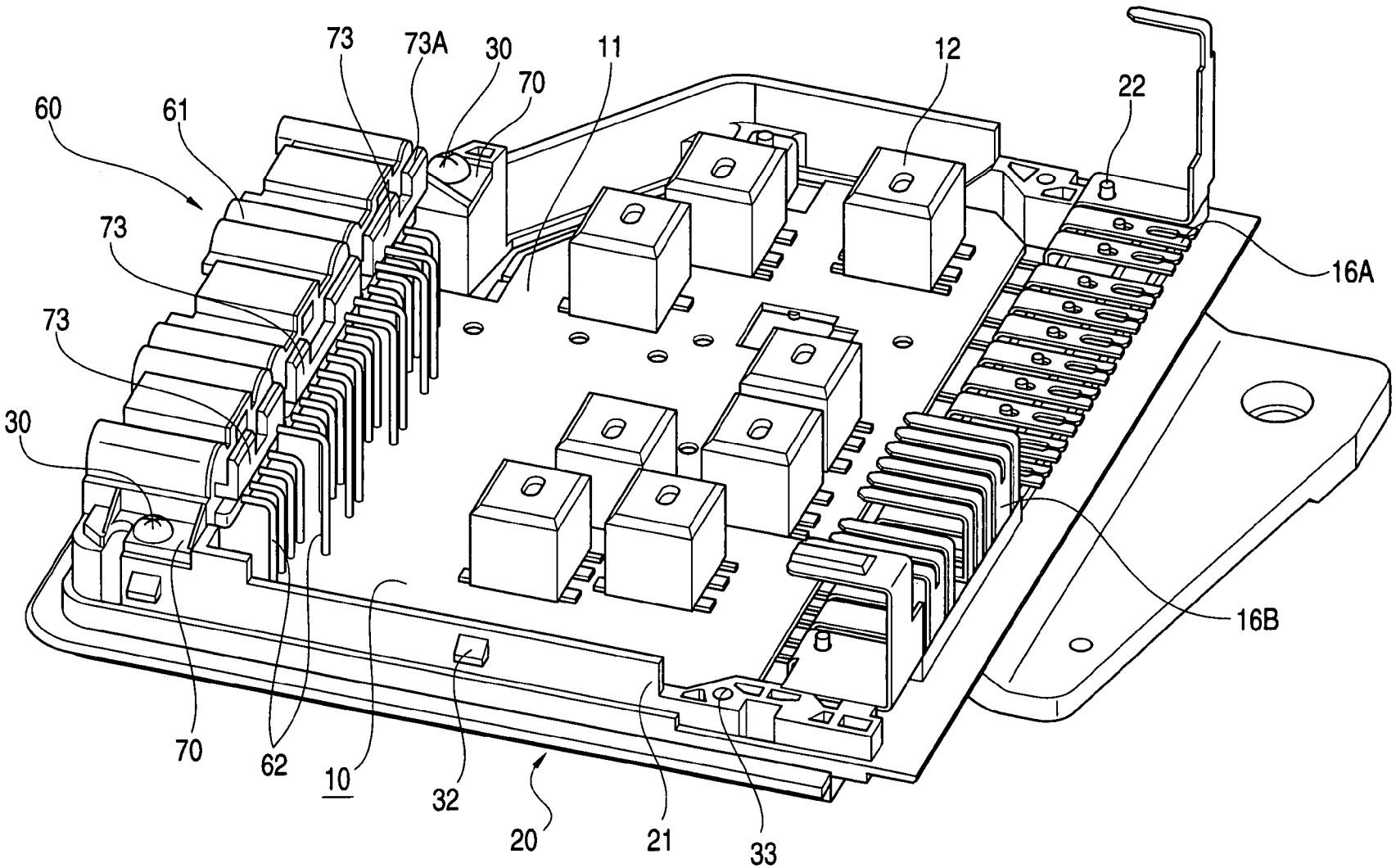
FIG. 12 is a perspective view of the rear side of the PCB connector in a state where the PCB connector is secured to the frame.

In contrast, three engaging pieces 73 are formed on the back surface side of PCB connector 60, as shown in FIGS. 12 and 14. Engaging pieces 73 are formed in an L shape which protrudes to the rear and rises at a right angle, and are formed so as to be aligned at intervals and be positioned on the respective back surface sides of the three chambers of PCB connector 60. Thus, in the case where cover 50 normally covers the upper surface of case 20, standing portions 73A of engaging pieces 73 are inserted into engaging trench 56, as described in detail below.

In addition, as shown in FIG. 13, sandwiching portion 58 which can sandwich the left and right sides of housing 61 of PCB connector 60 is provided to the two end portions, left and right, of the front end of the high level portion 51 so as to protrude to the front.

Fuse Box 80 is made of a synthetic resin and formed in laterally long form so as to cover the rear surface side of frame 21 along he entirety of the length, as shown in FIG. 2, and connector parts 81 having an opening in the front are provided in the two end portions in the direction of the length, and in addition, a fuse attachment part 82 is provided to the left and a terminal including part 83 is provided to the right, respectively, between the two end portions as viewed from the front.

A number of attachment holes 82A to which fuses 84 are attached are provided in fuse attachment part 82 so as to open on the rear surface side, as shown in FIG. 14, and a bus bar 16A is attached to the lower side of each attachment hole 82A by compressive insertion so that the end faces backward, and a connection terminal 85 in tab form which makes a pair with this bus bar 16 is attached to the upper side in the same manner, by compressive insertion, while the front end of connection terminal 85 in tab form is formed so as to be bent in a crank form and protrudes to the front. Meanwhile, bus bars 16B of which the ends face the front are included in connector parts 81 and terminal including parts 83.

A relay connector 90 can be coupled to the front surface of the region that ranges from fuse attachment part 82 and terminal including part 83 in fuse box 80, and the upper sides of connection terminals 85 and bus bars 16B that protrude to the front from fuse attachment part 82 and terminal including part 83 enter into an engagement portion 91 which opens in the front portion of relay connector 90.

Next, an example of a manufacturing process for an electrical connection box is described. A bus bar substrate 15 is formed by carrying out a pressing process on a metal plate material, and a circuit board 11 is made to adhere to the upper surface of this bus bar substrate 15 via an insulating adhesive sheet (not shown) so as to be integrated, and thus, a circuit forming board 10 is formed. At this time, bus bars 16 that protrude from the rear end of bus bar substrate 15 are bent and processed into the form. After that, electrical parts 12 are mounted on the conductive paths of circuit board 11 and bus bar substrate 15 by reflow soldering.

Next, as shown in FIG. 4, a PCB connector 16 is placed on the front end side of the surface of circuit board 11, and at the same time, protruding ends of male terminals 62 that face downward are made to penetrate through corresponding through holes 13 of circuit board 11. Subsequently, as shown in FIG. 5, attachment legs 66 that are placed on the surface of circuit board 11 are secured by tapping screws 67. After that, male terminals 62 are connected to the land portions formed around through holes 13 on the rear surface side by flow soldering (soldered portions 65).

As described above, circuit forming board 10 on which PCB connector 60 has been mounted is assembled from the above into frame 21, as shown in FIG. 6. At this time, positioning pins 22 that have been provided to the upper surface of frame 21 are inserted for positioning into positioning holes 18 that have been formed in bus bar substrate 15 and bus bars 16. In addition, as shown in FIGS. 7 and 8, engagement protrusions 26 that stand on attachment surface 25 of frame 21 are fitted into through holes 71 that open in attachment plates 70 on the left and on the right of PCB connector 60.

Figure 10:
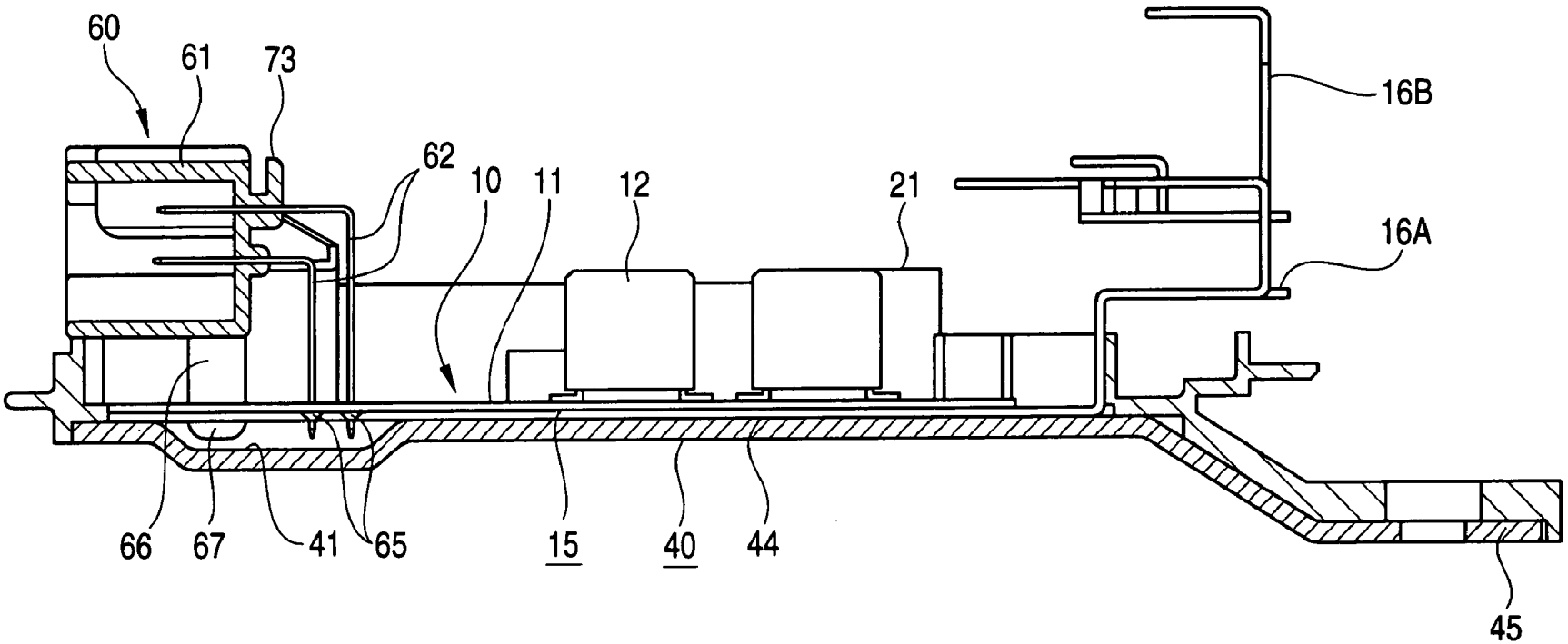
FIG. 10 is a cross sectional side view of the frame in a state where a heat radiating plate has been attached to the lower surface.

Next, an insulating adhesive 44 is applied to the entirety of the upper surface of heat radiating plate 40, and, as shown in FIGS. 9 and 10, heat radiating plate 40 is made to adhere to the lower surface of bus bar substrate 15 and the lower surface of frame 21 in circuit forming board 10. After that, as shown in FIG. 11, tapping screws 42 are inserted into penetrating holes 43 which open in the periphery of heat radiating plate 40 and secured by being screwed into screw holes 34 (downward holes) that have been formed in the lower surface of frame 21. As a result of this, circuit forming board 10 is secured to case 20.

Subsequently, PCB connector 60 is secured to frame 21. Namely, as shown at the right side of FIG. 11, a tapping screw 30 with a head 30A is screwed into a screw hole 27 in an engaging protrusion 26 which is engaged with a through hole 71 of attachment plate 70 of PCB connector 60.

Tapping screw 30 is screwed until the lower surface of head 30A hits the upper surface of engaging protrusion 26, as shown at the left side of this figure, in a manner where head 30A of tapping screw 30 stops at the end of through hole 71 on the upper side of attachment plate 70, preventing the attachment plate from coming off.

Here, in the case where, for example, PCB connector 60 is shifted in position in the direction where it is lifted from circuit forming board 10 and attachment plate 70 is simply screwed to attachment surface 25, the front end side of PCB connector 60 that is not supported by an attachment leg 66 is displaced in a manner where it sinks when the form of male terminals 62 is elastically changed.

In the present embodiment, however, the plate thickness s of attachment plates 70 is set at a value that is smaller than that of height h of engaging protrusions 26, and therefore, even in the case where PCB connector 60 is shifted in position in the direction where it is lifted from circuit forming board 10, clearances still remain between heads 30A of tapping screws 30 and the ends of through holes 71, as shown in the enlarged view of FIG. 11, and thus, attachment plate 70 is not forced down. That is to say, PCB connector 60 can be prevented from being displaced downward when the form of male terminals 62 is elastically changed, and as a result, the occurrence of remaining stress can be prevented in portions 65 where male terminals 62 have been soldered to through holes 13 of circuit board 11. Accordingly, soldered portions 65 can be prevented from being damaged, for example, cracked.

When screwing in PCB connector 60 is completed, a potting agent, such as a gel (not shown), is put into frame 21, so that the surface of circuit board 11 is coated with the potting agent, and thus, water repelling properties are secured.

After that, as shown in FIG. 13, the PCB connector is covered from above with cover 50. Cover 50 is pressed while the form of locking pieces 53 is being elastically changed, and when the cover is pushed into a normal position, locking pieces 53 elastically engage with locking protrusions 33 that have been provided in frame 21.

Meanwhile, as shown in FIG. 14, standing portions 73A of engaging pieces 73 that have been provided on the rear of PCB connector 60 enter into engaging trenches 56 that have been provided on the rear of high level portions 51 of cover 50, that is to say, displacement of PCB connector 60 in the frontward and backward direction is restricted. At the same time, as shown in FIG. 1, left and right sandwiching parts 58 sandwich PCB connector 60 from the left and from the right. When cover 50 is locked, the tapping screws that have been placed into attachment recesses 54 on the two end portions, left and right, on the rear end side of cover 50 are screwed into and secured to screw holes 33 that have been provided in the upper surface of the left and right side walls of frame 21.

Subsequently, fuse box 80, to which connection terminals 85 have been attached in advance, is assembled into the rear end of case 20.

Accompanying the assembly of fuse box 80, bus bars 16A, which are provided so as to protrude from bus bar substrate 15, enter into and are attached to the lower side of the corresponding attachment holes 82A in fuse attachment part 82, as shown in FIG. 14. In addition, bus bars 16B of which the ends face the front are included in terminal including part 83 and connector parts 81. Finally, relay connector 90 is engaged with the front surface of fuse box 80, and thus, an electrical connection box as that shown in FIG. 1 is completed.

In this electrical connection box, fuses 84 are attached from the rear surface to respective attachment holes 82A of fuse attachment part 82. In addition, opposing connectors (not shown) are engaged from the front surface with PCB connector 60 and relay connector 90. In addition, this electrical connection box is included within the casing of a relay box, in a state where it is placed in the longitudinal direction with PCB connector 60 facing downward, and attached in this state to a car panel in the engine room on the fender side via attachment piece 45 of heat radiating plate 40.

In particular, when an opposing connector is engaged with PCB connector 60 and removed for the purpose of maintenance, a pushing or pulling force in the forward and backward direction is applied to PCB connector 60. Here, though attachment plate 70 of PCB connector 60 on both sides are screwed, the PCB connector 60 can be slightly displaced in the upward and downward direction, and therefore, there is a possibility that the PCB connector 60 is displaced in a manner where the upper side swings to the front and to the rear. However, standing part 73A of engaging piece 73 that has been provided on the rear side of PCB connector 60 enters into engaging trench 56 on the rear side of cover 50 that has been secured to frame 21, and therefore, the displacement of PCB connector 60 in a manner where the upper side swings to the front and to the rear can be restricted. That is to say, PCB connector 60 can be prevented from being displaced to the front and to the rear when the form of male terminals 62 is elastically changed.

In addition, sandwiching part 58 that is provided in cover 50 sandwiches the two sides of PCB connector 60, and thereby, twisting becomes difficult when an opposing connector is engaged or removed, and thus, the form of male terminals 62 can be prevented from being changed. Accordingly, in the same manner, soldered portions 65 of male terminals 62 can be prevented from being damaged, for example, cracked.

As described above, according to the present Embodiment, standing parts 73A of engaging pieces 73 which are provided on the rear side of PCB connector 60 are fitted into engaging trenches 56 which are provided on the rear side of cover 50, and thereby, shifting of PCB connector 60 in the forward and backward direction can be restricted. That is to say, in the case where pushing or pulling force in the forward and backward direction is applied to PCB connector 60 when an opposing connector is engaged or removed, displacement of PCB connector 60 in a manner where it swings to the front and to the rear can be restricted. Therefore, a change in the form of male terminals 62 can be prevented, and soldered portions 65 of male terminals 62 can be prevented from being damaged, for example, cracked. As a result, high reliability can be gained in an electrical connection between PCB connector 60 and circuit forming board 10.

In addition, restriction in the movement of PCB connector 60 in the forward and backward direction can be automatically achieved when cover 50 is attached, and therefore, production efficiency is high.

In addition, sandwiching part 58 that is provided to cover 50 sandwiches the two sides of PCB connector 60, and thereby, twisting of the PCB connector becomes difficult when an opposing connector is engaged and removed, and thus, the form of male terminals 62 can be prevented from being changed, in the same manner. As a result of this, effects of preventing damage in soldered portions 65 of male terminals 62 can be achieved.

Other Embodiments

The present invention is not limited to the embodiment described in the above with reference to the drawings, but rather, the following embodiments, for example, are also included in the technical scope of the present invention, and in addition to the following, the invention can be implemented by modifying the embodiments in a variety of manners, within a scope where the spirit of the invention does not deviated from.

(1) An engaging piece may be formed on the cover side and an engaging trench may be formed on the PCB connector side in a manner opposite that of the above-described embodiment.

(2) Protruding portion and recess portion as a restricting member may be pins and holes into which the pins are fitted.

(3) Surface mounting by reflow soldering may be used as the means for connecting a terminal fitting of the PCB connector to a conductive path of the circuit forming board. Such an embodiment is also included in the technical scope of the present invention.

(4) Though in the embodiment, the above-described bottom plate of the case is formed of a heat radiating plate, the bottom plate of the case may be provided separately from the heat radiating plate.

What is claimed is:

1. An electrical connection box comprising:

a case having an opening, the case housing a circuit forming board including a conductive path;

a connector being mounted on the circuit forming board to face an outside from an opening end side of the case, the connector having a fitting surface which face in a direction along a board surface of the circuit forming board;

a terminal fitting being attached to the connector, the terminal fitting being connected to the conductive path of the circuit forming board by soldering;

a cover being attached to the opening of the case; and an engagement structure capable of restricting a displacement of the connector along a first direction where the connector is engaged with an opposing connector and along a second direction generally orthogonal to a plane parallel to the board surface including:

a restricting arrangement being provided between the cover and the connector, and an engaging portion being provided with the case and forming a clearance between the connector and the case.

2. The electrical connection box according to claim 1, wherein the restricting arrangement includes a protruding portion being provided with the connector and a recess portion being provided with the cover, and the protruding and recess portions capable of fitting together when the cover is attached to the opening of the case.

3. The electrical connection box according to claim 1, wherein a sandwiching portion for sandwiching both sides of said connector is provided to the cover.

* * * * *